US012252944B1

(12) United States Patent
Nebiolo et al.

(10) Patent No.: US 12,252,944 B1
(45) Date of Patent: Mar. 18, 2025

(54) HIGH TEMPERATURE FLUID-DRIVEN DUAL-MODE CIRCULATION TOOL

(71) Applicant: PROSHALE LLC, Spring, TX (US)

(72) Inventors: Martin Mauro Nebiolo, Neuquén Capital (AR); Cristian Brendstrup, Neuquén Capital (AR); Christian Cerne, Spring, TX (US); Gustavo Dietrich, Neuquén Capital (AR)

(73) Assignee: PROSHALE LLC, Spring, TX (US)

( * ) Notice: Subject to any disclaimer, the term of this patent is extended or adjusted under 35 U.S.C. 154(b) by 0 days.

(21) Appl. No.: 18/907,685

(22) Filed: Oct. 7, 2024

(51) Int. Cl.

| | |
|---|---|
| ***E21B 21/10*** | (2006.01) |
| ***E21B 23/00*** | (2006.01) |
| ***E21B 34/10*** | (2006.01) |
| ***E21B 34/12*** | (2006.01) |

(52) U.S. Cl.
CPC ..... *E21B 21/103* (2013.01); *E21B 23/004* (2013.01); *E21B 23/006* (2013.01); *E21B 34/10* (2013.01); *E21B 34/12* (2013.01); *E21B 2200/04* (2020.05); *E21B 2200/06* (2020.05)

(58) Field of Classification Search
CPC .... E21B 21/103; E21B 23/004; E21B 23/006; E21B 34/10; E21B 34/12; E21B 2200/06; E21B 2200/04
See application file for complete search history.

(56) References Cited

U.S. PATENT DOCUMENTS

| | | | | |
|---|---|---|---|---|
| 6,378,612 | B1 * | 4/2002 | Churchill | E21B 34/102 166/321 |
| 9,145,748 | B1 * | 9/2015 | Meier | E21B 21/103 |
| 2011/0120773 | A1 * | 5/2011 | Hilliard | E21B 21/103 175/57 |
| 2020/0190945 | A1 * | 6/2020 | Buckland | E21B 21/103 |
| 2022/0341288 | A1 * | 10/2022 | Storie | E21B 21/103 |

* cited by examiner

*Primary Examiner* — Robert E Fuller
*Assistant Examiner* — Neel Girish Patel
(74) *Attorney, Agent, or Firm* — Eric P. Mirabel

(57) ABSTRACT

Disclosed is a fluid-driven dual-mode circulation tool which is suitable for high-temperature applications, and which is operable to switch between a flow-through mode and an annular-flow mode. Switching modes is accomplished by interrupting (or reducing) and then reinstating the flow of pressurized fluid through it. In the flow-through mode, pressurized fluid flows out of the tool into the bottom hole assembly. In the annular-flow mode, the tool diverts fluid through internal paths that access the annulus of the well-bore or casing through one or more apertures on the sidewall of the tool.

14 Claims, 9 Drawing Sheets

HIGH TEMPERATURE FLUID-DRIVEN DUAL-MODE CIRCULATION TOOL

BACKGROUND

In certain scenarios, it may be crucial to allow fluid to flow through a specific section of a drill string, while in others, it may be necessary to prevent fluid flow through a particular section. Additionally, for a circulating tool, selectively permitting or preventing the fluid to flow through the sidewall of the tubular string is advantageous.

Still further, in high temperature environments (such as above 350° F.), elastomer or polymer based seals (such as those made of plastics and rubbers), used for sealing/unsealing the flow of fluid through the tool, often fail to perform or are not reliable. In such cases, it would be desired to have a "metal-metal" or "metal-on-metal" based sealing/unsealing mechanism. In such sealing/unsealing mechanism, sealing or unsealing of fluid flowing through the tool will occur between metallic surfaces, and the seals will remain effective even at higher temperatures, where elastomeric/polymeric seals tend to fail.

Hence, there is a need for a downhole circulating tool equipped with fluid pressure-regulating the valve cycling, and which would be robust enough to perform even in high temperature environments. Such a tool should be hydraulically controllable from the surface and should allow unlimited switching between two operational modes (i.e., the flow-through mode and the annular mode) by simply adjusting the fluid flow rate. Still further, such a tool should be integrable into the Bottom Hole Assembly (BHA), which is connected through a work string, such as coiled tubing or threaded pipe. The tool should be suitable for deployment in offshore or onshore wellbores across various applications, including oil and gas drilling. The valve cycling is performed by a surface pump that connects to the drill work string and to the BHA.

SUMMARY

The invention is an improved fluid-driven, dual-mode circulation tool where sealing/unsealing is between metallic surfaces, and the sealing/unsealing cycles interrupt (or reduce) and then reinstate flow fluid flow through the tool. The tool is suitable for high-temperature applications because of the metallic seals.

Interrupting and then reinstating the flow of pressurized fluid causes the tool to switch between two operating modes: flow-through mode and annular-flow mode. In the flow-through mode, pressurized fluid flows out of the tool into the downhole assembly. However, in the annular-flow mode, the tool diverts fluid through internal fluid ejection paths that access the annulus of the wellbore through one or more apertures on the sidewall of the tool, to thereby perform the circulation function of the tool.

The tool includes a guiding cylinder, a cage cylinder and a ratchet tube which are axially aligned. The outer surface of the ratchet tube includes a zig-zagging ratchet path with alternating peaks and valleys. The ratchet path is connected with several peak channels extending longitudinally from the ratchet path towards upper end of the ratchet tube. Outer pins extending from the inner surface of the guiding cylinder engage with the peak channels of the ratchet tube. Inner pins extending from inner surface of the cage cylinder engage with the ratchet path or with a peak channel. While the guiding cylinder and the cage cylinder are longitudinally fixed within the tool, the ratchet tube is slidable in a confined range within the tool. Neither the ratchet tube nor the guiding cylinder can rotate. The cage cylinder can rotate on its axis.

Longitudinal sliding of the ratchet tube causes the edges of peaks or valleys of ratchet path to push against the inner pins of the cage cylinder. Since the cage cylinder is rotatable (but the ratchet tube is not), the longitudinal sliding of the ratchet tube causes the inner pins to slide along the edges of peaks or valleys and hence rotate the cage cylinder. The peaks or valleys of ratchet path are mated such that longitudinal sliding of the ratchet tube causes the cage cylinder to rotate, and the inner pins to revolve unidirectionally around the cage cylinder's axis.

During tool operation, downward sliding (or down strokes) of the ratchet tube induces unidirectional rotation of the cage cylinder such that on every downstroke, a pair of metallic sealing balls (preferably made of a metal alloy such as steel), included in the cage cylinder alternately seal the entrances of one of the two pairs of fluid ejection paths included in the tool. The alternate sealing induced by downstrokes of the ratchet tube is controlled by interrupting (or reducing) and then reinstating the flow of pressurized fluid through the tool.

When the entrances of the first pair of fluid ejection paths are sealed, pressurized fluid flows through the second pair of fluid ejection paths results in all the fluid being pumped from surface to flow through the tool, get ejected from the lower end of the tool, and finally get delivered to the BHA installed below it. This mode is referred to as the "flow-through" mode.

When the entrances of the second pair of fluid ejection paths are sealed, pressurized fluid flows through the first pair of fluid ejection paths, thereby directing all the fluid to the annulus of the wellbore (or the casing) surrounding the tool. This mode is referred as "annular-flow" mode. In the annular-flow mode of operation, no fluid is directed into the BHA installed below the tool. Hence, switching of the tool's operation between "flow-through" and "annular-flow" mode is achieved by interrupting (or reducing) and then reinstating flow of pressurized fluid through the tool.

Embodiments of the present invention will be discussed in greater detail with reference to the accompanying figures in the detailed description that follows.

BRIEF DESCRIPTION OF THE DRAWINGS

FIGS. 3A and 3B are cross-sections of the tool at the same stage, except that the cross-section of FIG. 3B is taken from a plane which is transverse to the cutting plane of FIG. 3A.

FIGS. 4A and 4B are cross-sections of the tool at the same stage, except that the cross-section of FIG. 4B is taken from a plane which is transverse to the cutting plane of FIG. 4A.

It should be understood that the drawings and the associated descriptions below are intended to illustrate one or more embodiments of the present invention, and not to limit the scope or the number of different possible embodiments of the invention.

In the description of the invention which follows, unless specified otherwise, terms 'upper', 'upward' and 'upwards' are used to denote a direction upwards towards top of the well-bore or towards the source of fluid flowing through the tool. Similarly, terms 'lower', 'downward' and 'downwards' are used to denote a direction downwards towards the base of the well-bore or towards the direction of fluid flowing through the tool, which is left to right in all figures.

Some components and/or portions of the embodiments of the invention illustrated in the figures may not be fully discussed in the description which follows, because they are not needed to provide a full and complete description of the embodiments of the invention, which is adequate for comprehension by anyone with relevant experience in the field.

Drawings are not necessarily drawn to scale.

DETAILED DESCRIPTION

Reference will now be made in detail to a first embodiment of a fluid-driven dual-mode circulation tool of the invention which is suitable for high-temperature applications, with reference to the accompanying drawings.

Figure 1A:
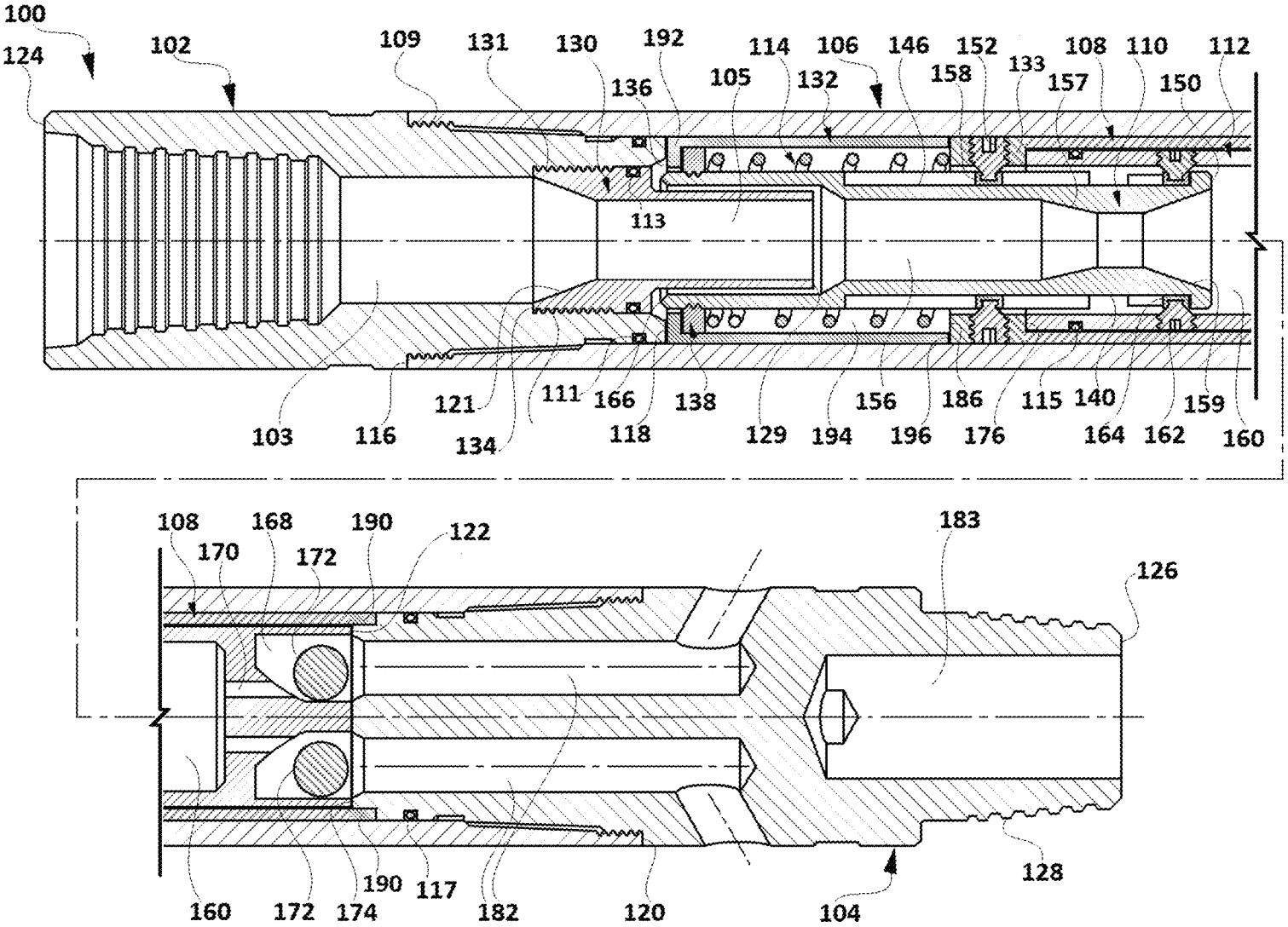
FIG. 1A is a longitudinal cross-sectional view of the fluid-driven dual-mode circulation tool, positioned at rest prior to fluid flow.

As shown in FIG. 1A, tool 100 includes an upper sub 102, a lower sub 104, a barrel 106, a guiding cylinder 108, a ratchet tube 110, a cage cylinder 112, a compression spring 114, a primary tube 130, a sleeve tube 132 and a flange 138.

Upper sub 102 further includes a central bore 103, an externally threaded region 109 near its mid-section and an internally threaded region 131 towards its lower end 118. The primary tube 130 includes an externally threaded upper end 134, a lower end 129 and a central bore 105. In assembled tool 100, the externally threaded upper end 134 of the primary tube 130 is screwed with internally threaded region 131 towards the lower end 118 of upper sub 102. The upper portion of the central bore 105 of the primary tube 130 tapers outwardly to an expanded region 121.

Figure 2A:
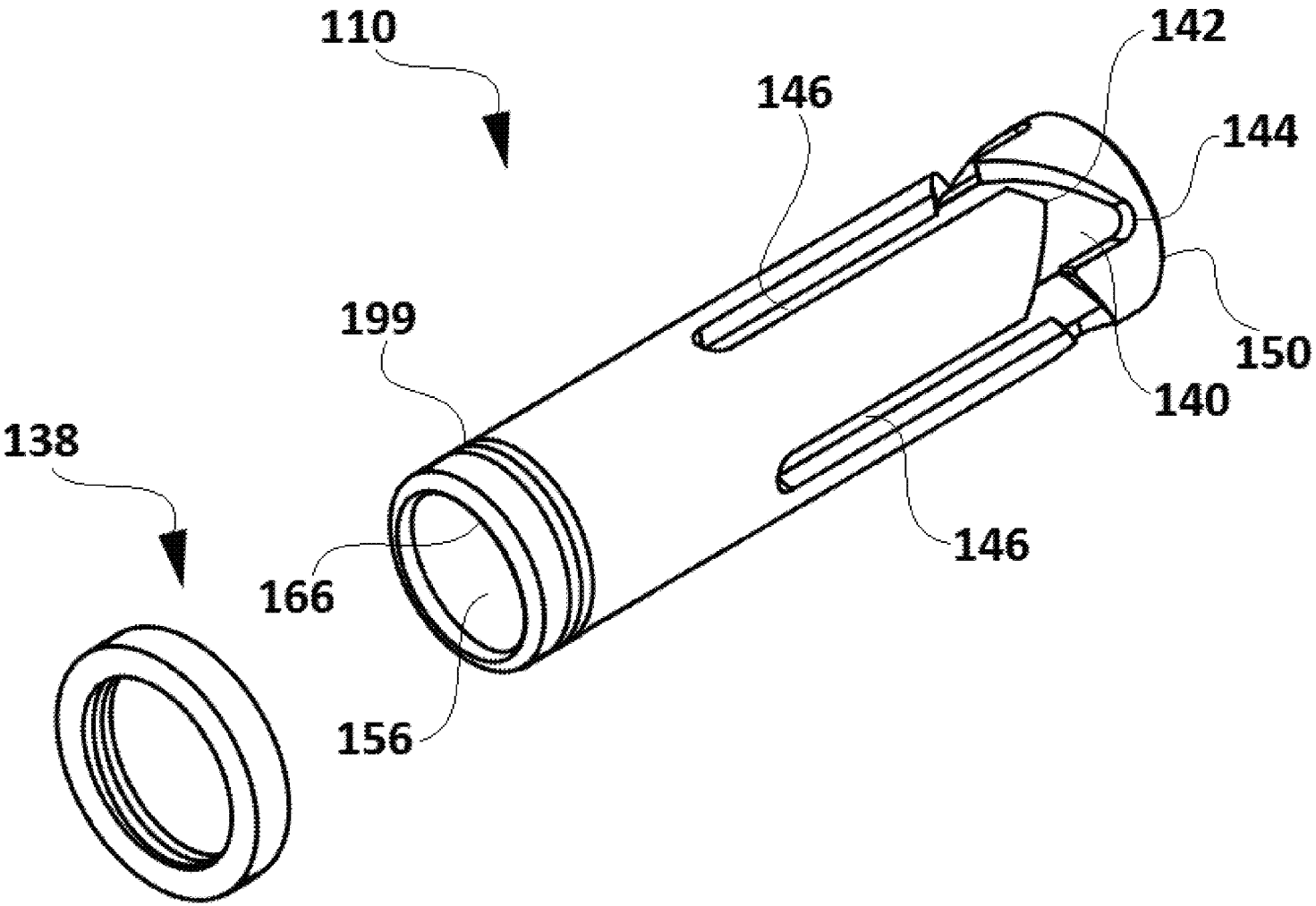
FIG. 2A is a perspective view of a ratchet tube for the tool of FIG. 1A, with an accompanying flange.

As illustrated in FIGS. 1A and 2A, the outer surface of ratchet tube 110, towards its lower end 150, has a zig-zagging ratchet path 140 with four alternating peaks 142 and valley crests 144. Four peak channels 146 extend longitudinally from ratchet path 140 towards the upper end 166 of ratchet tube 110. Ratchet tube 110 has a central bore 156 which includes a contracting tapered flow section 157 connecting through a mid-section with an expanding flow section 159 towards its lower end 150. Ratchet tube 110 further includes an externally threaded region 199 towards its upper end 166 (see FIG. 2A). The internally threaded flange 138 screws onto the threaded region 199.

Figure 2B:
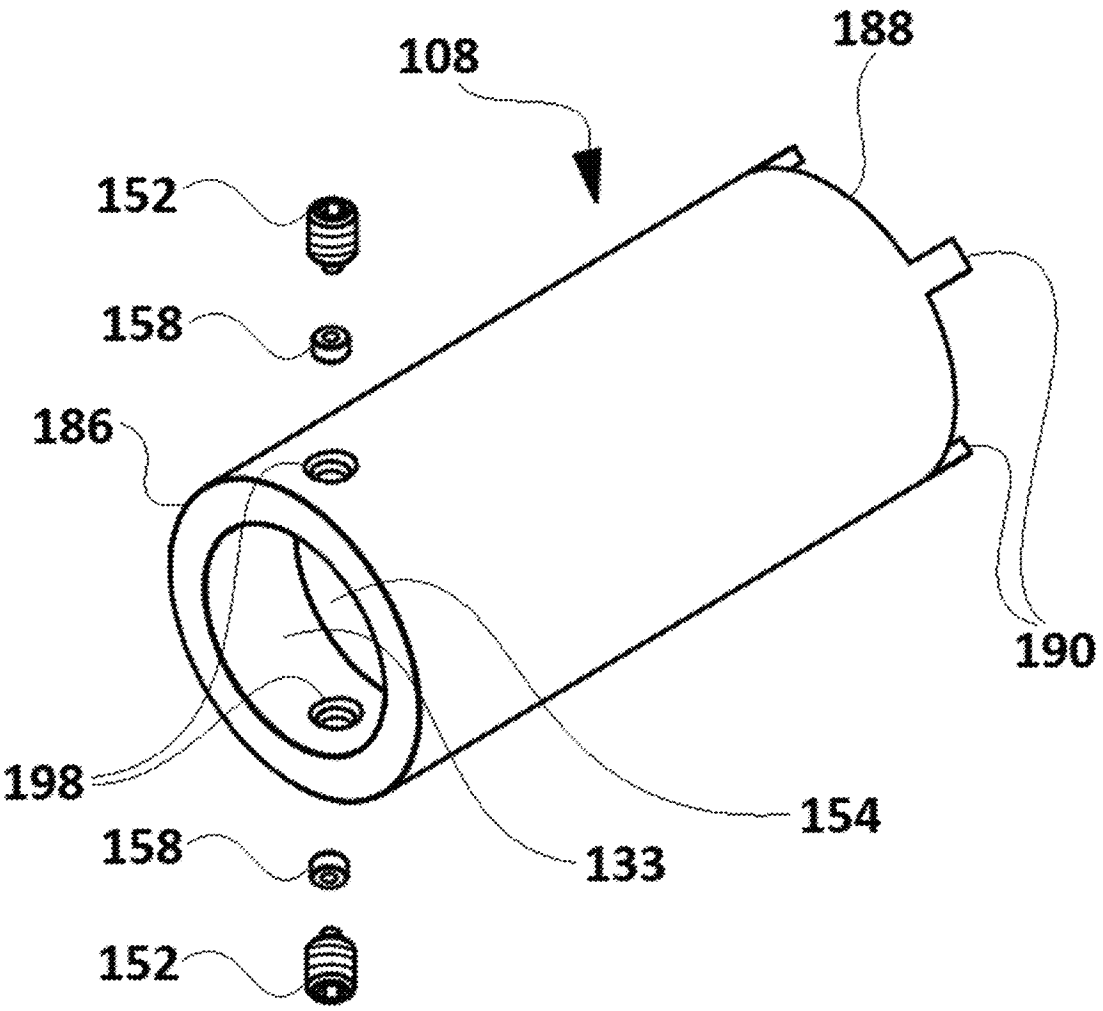
FIG. 2B is a perspective view of a guiding cylinder for the tool of FIG. 1A.

Guiding cylinder 108 includes an axially extending central bore 154 (see FIG. 2B). Towards its upper end 186, guiding cylinder 108 includes two opposed outer pins 152, each including an outer pin head 158 screwed on to itself. Each outer pin 152, having a corresponding outer pin head 158, is screwed into one of opposed threaded holes 198 on the guiding cylinder 108 such that the corresponding outer pin head 158 extends into the central bore 154 (see FIGS. 1A and 2B). An upper region 133 of guiding cylinder 108, lying towards the upper end 186, has a greater wall thickness than rest of the guiding cylinder 108 (see FIGS. 1A and 2B). Guiding cylinder 108 further includes four symmetrically distributed locking keys 190 which extend axially below its lower end 188 (see FIGS. 1A and 2B).

Figure 2C:
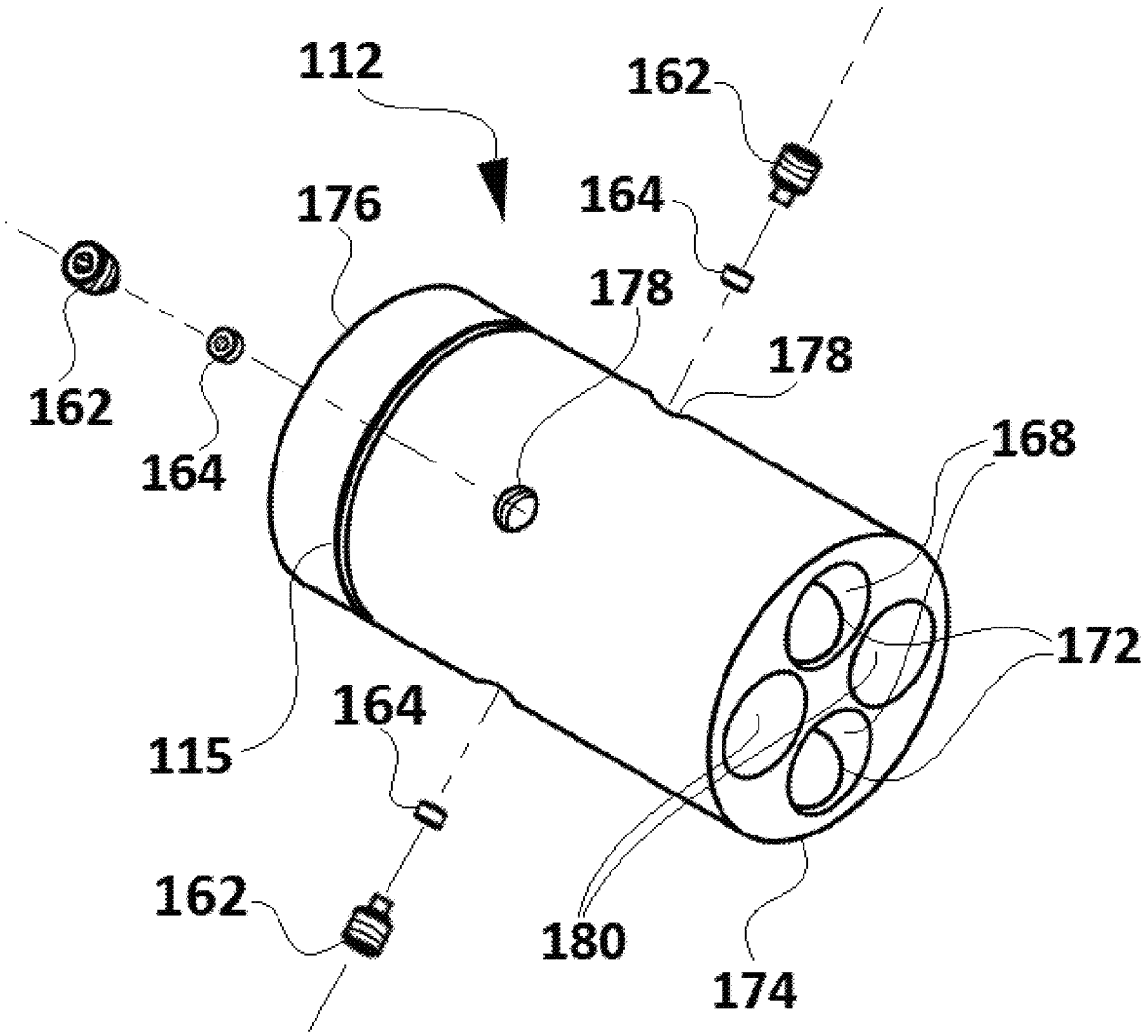
FIG. 2C is a perspective view of a cage cylinder for the tool of FIG. 1A.

Cage cylinder 112 (see FIGS. 1A and 2C) has a central bore 160, and includes four inner pins 162, each including a corresponding inner pin head 164. Inner pins 162, along with their respective inner pin heads 164 screw into threaded holes 178 and extend into the central bore 160. Threaded holes 178 are symmetrically distributed on the curved surface of cage cylinder 112. Towards its lower end, the central bore 160 of cage cylinder 112 bifurcates into two similar pairs of opposed flow channels being, a first pair of opposed flow channels 168 and a second pair of opposed flow channels 180, both of which open at the lower end 174 of cage cylinder 112. Each flow channel in the first pair of opposed flow channels 168 and the second opposed flow channels 180 is connected to the central bore 160 through a narrower connecting channel 170 (see FIG. 1A). All four connecting channels 170 are distributed symmetrically around the axis of cage cylinder 100 and are parallel to it, as are all four flow channels 168 and 180. None of these flow channels are interconnected. Adjacent flow channel 168 and 180 are evenly spaced around the axis of cage cylinder 112. A pair of metallic sealing ball 172 (preferably, made of a metal alloy such as steel) is placed into each of the first pair of the opposed flow channels 168. In assembled tool 100, metallic sealing balls 172 are confined to move only within their respective flow channels 168.

Figure 1B:
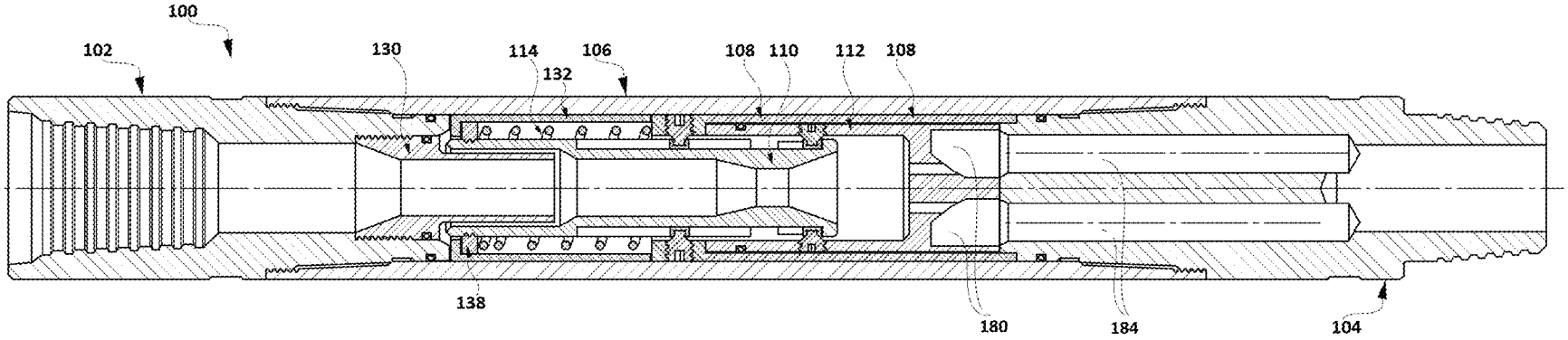
FIG. 1B is a longitudinal cross-sectional view tool of FIG. 1A taken along a cutting plane which is transverse to the cutting plane of the first longitudinal cross-section of FIG. 1A.
Figure 2D:
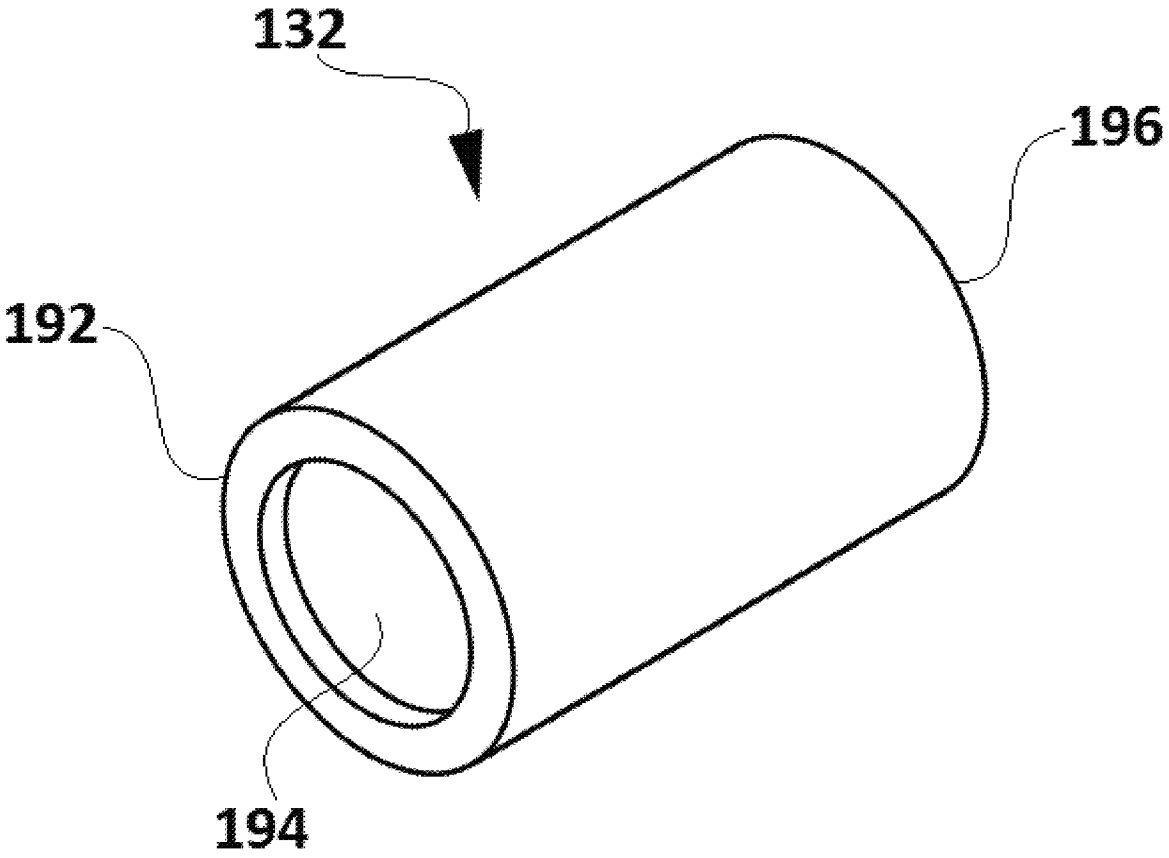
FIG. 2D is a perspective view of a sleeve tube for the tool of FIG. 1A.
Figure 2E:
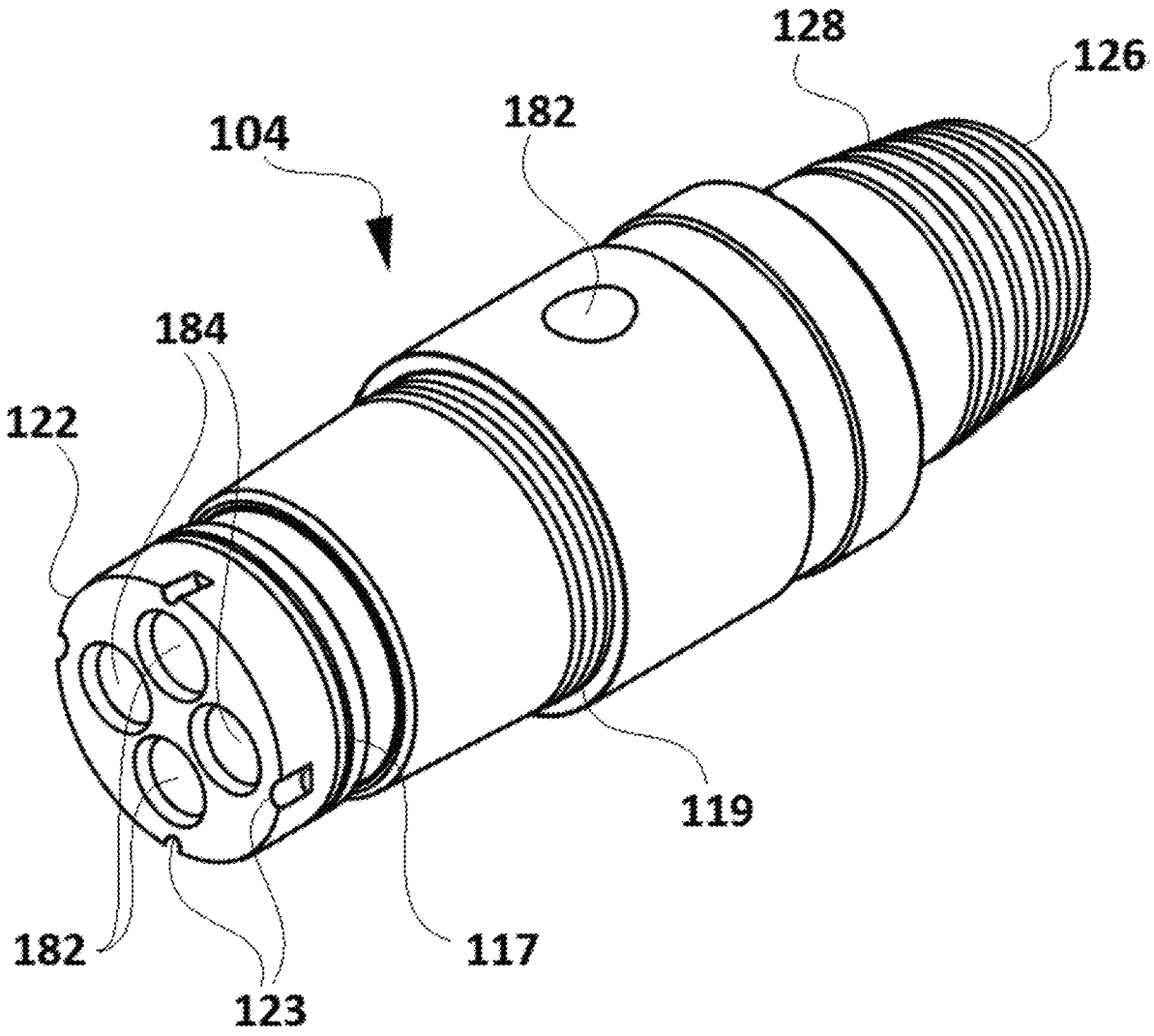
FIG. 2E is a perspective view of a lower sub for the tool of FIG. 1A.

Upper end 122 of lower sub 104 has entrances for two pairs of opposed fluid ejection paths, i.e., the first pair of opposed fluid ejection paths 182 and the second pair of opposed fluid ejection paths 184 (see FIG. 2E). While each of the first pair of fluid ejection paths 182 have an exit path on the side of lower sub 104, the second pair of fluid ejection paths 184 extend to a bore 183 lying towards the lower end 126 of lower sub 104 (see FIG. 1B). Each of the four fluid ejection paths 182 and 184 lie symmetrically around the axis of lower sub 104 and are not interconnected. Four longitudinal key slots 123 (see FIG. 2E) lie on the curved surface of lower sub 104, and extend to its upper edge 122. The longitudinal key slots 123 are distributed symmetrically around the axis of lower sub 104. The locking keys 190 of guiding cylinder 108 matingly fit into the longitudinal key slots 123 in assembled tool 100.

The internal diameter of each of the first pair of opposed flow channels 168 and of the second opposed flow channels 180 is larger than the diameter of each fluid ejection path of the first pair of opposed fluid ejection paths 182 and of the second pair of opposed fluid ejection paths 184. Further, the outer diameter of each metallic sealing ball 172 is larger than the internal diameter of each of the first and second pairs of opposed fluid ejection paths 182 and 184, but is sized to snugly fit into each of the first and second pairs of opposed flow channels 168 and 180.

Sleeve tube 132, shown in FIG. 2D, includes an upper end 192, a lower end 196 and a central bore 194. The upper end 192 is an internal annular flange. Hence, the upper end 192 of sleeve tube 132 has a reduced internal diameter with respect to the rest of the Sleeve tube 132 (See FIG. 1A).

To assemble the tool 100, first of all, a 'ratchet assembly' is prepared by assembling sleeve tube 132, guiding cylinder 108, ratchet tube 110, cage cylinder 112, compression spring 114, flange 138 and two metallic sealing balls 172. In the first step, all the outer pins 152 and all the inner pins 162, having respective pin heads 158 and 164 screwed to them, are unscrewed and removed from guiding cylinder 108 and cage cylinder 112. Thereafter, the lower end 150 of ratchet tube 110 is slid into the upper end 176 of cage cylinder 112, and cage cylinder 112 is aligned over ratchet tube 110 such that the threaded holes 178 of cage cylinder 112 are aligned over ratchet path 140. In the next step, each inner pin 162, having its corresponding inner pin heads 164 screwed to it, is screwed into one of the threaded holes 178 on cage cylinder 112 to engage each inner pin head 164 with the ratchet path 140.

Once the inner pins 162 are screwed into cage cylinder 112, the upper end 166 of ratchet tube 110, having inner pin heads 164 engaged, is slid into the lower end 188 (see FIG. 2B) of guiding cylinder 108 such that the upper end 176 of cage cylinder 112 is positioned adjacent to the thicker upper region 133 of guiding cylinder 108. In the following step, ratchet tube 110 is rotated to align any two of the opposed peak channels 146 to lie under threaded holes 198 on guiding cylinder 108, and then each outer pin 152, having its corresponding outer pin head 158 screwed to it, is screwed to one of the threaded holes 198 to position each outer pin head 158 in a peak channel 146.

In the next step, spring 114 is slid over ratchet tube 110 from its upper end 166. Thereafter, flange 138 is screwed onto the externally threaded region 199 of ratchet tube 110. Thereafter, sleeve tube 132 is slid over flange 138 such that the lower end 196 of sleeve tube 132 is positioned adjacent to the upper end 186 of guiding cylinder 108, and the upper end 192 of sleeve tube 132 is positioned adjacent to the flange 138 (see FIG. 1A). Finally, to complete ratchet assembly, from the lower end 174 of cage cylinder 112, metallic sealing balls 172 are inserted into exits of each of flow channels 168.

To assemble the ratchet assembly, the externally threaded upper end 134 of primary tube 130 is screwed into the internally threaded region 131 of upper sub 102, and then the internally threaded upper end 116 of covering barrel 106 is screwed over the externally threaded region 109 of upper sub 102. Thereafter, keeping metallic sealing balls 172 inserted within their respective flow channels 168, ratchet assembly is slid into barrel 106 such that the sleeve tube 132 gets placed towards the upper end 116 of barrel 106. Thereafter, the upper end 122 of lower sub 104 is inserted into the lower end 120 of barrel 106, and aligned with the ratchet assembly in a manner such that each protruding locking key 190 of guiding cylinder 108 (note that all four locking keys 190 of guiding cylinder 108 extend below the lower end 174 of cage cylinder 112) is placed within a corresponding key slot 123 of lower sub 104. With each locking key 190 matingly placed in a corresponding key slot 123, the externally threaded region 119 of lower sub 104 (see FIG. 2E) is screwed into the internally threaded lower end 120 of barrel 106 to complete the assembly of tool 100. Mating engagement of each locking key 190 in a corresponding key slot 123 of the lower sub 104 renders the guiding cylinder 108 non-rotatable with respect to the lower sub 104 (and with respect to the entire assembled tool 100).

Screwing in lower sub 104 may require some rotational force to overcome compressive resistance of spring 114. In assembled tool 100, spring 114 gets confined between flange 138 and the upper end 186 of guiding cylinder 108.

In assembled tool 100, the ratchet assembly stays locked between upper sub 102 and lower sub 104. Within tool 100, guiding cylinder 108, cage cylinder 112 and ratchet tube 110 are axially aligned, and guiding cylinder 108 surrounds at least a portion of ratchet tube 110 and cage cylinder 112. Cage cylinder 112 also surrounds at least a portion of ratchet tube 110.

Due to engagement of the locking pins 190 with their corresponding key slots 123, and presence of sleeve tube 132 and lower sub 104 at either end, the guiding cylinder 108 is rotationally and longitudinally fixed within tool 100. Similarly, since cage cylinder 112 is positioned between guiding cylinder 108 and the upper end 122 of lower sub 104, the cage cylinder 112 is also longitudinally fixed within tool 100.

Still further, in assembled tool 100, since peak channels 146 of ratchet tube 110 are engaged with outer pins heads 158, the ratchet tube 110 is rotationally fixed, but slidable longitudinally in a confined range within the ratchet assembly (or within tool 100). Similarly, since the inner pins heads 164 are engaged with ratchet path 140, cage cylinder 112 along with inner pins 162 and their respective inner pin heads 164, on application of sufficient torque, is rotatable on its axis upon longitudinal displacement of ratchet tube 110.

The engagement of the outer pin heads 162 with ratchet path 140 is such that the downward slide of ratchet tube 110 causes the outer pin heads 162 to strike and slide along the slant edges of the peaks 142 (and may cause them to enter an adjacent peak channel 146), and upward slide of ratchet tube 110 causes the inner pin heads 164 to slide out of the peak channel 146, if they were there, and strike and slide along the slant edges of valley crests 144. The mating structure of the peaks 142 and valley crests 144 of ratchet path 140 is such that, the striking and sliding of the inner pin heads 164 on slant edges of either peaks 142 or valley crests 144 induces a unidirectional rotational torque on cage cylinder 112 and results in its rotation in the same direction.

Irrespective of the direction of longitudinal displacement (or sliding) of ratchet tube 110, the rotational torque on cage cylinder 112 always is either clockwise or counter-clockwise. A complete downward slide or a complete upward slide of ratchet tube 110 induces a 45 degree rotation of cage cylinder 112.

In an operating tool 100, the engagement of the outer pins 152, having their outer pin heads 158 screwed to them, with their corresponding peak channels 146 is always maintained. Similarly, the engagement of the inner pins 162, having their inner pin heads 164 screwed to them, with ratchet path 140 (or with a corresponding peak channel 146, after a downward slide of ratchet tube 110) is always maintained.

It is to be noted that since guiding cylinder 108 is longitudinally and rotationally fixed within assembled tool 100, outer pins 152, which are screwed into guiding cylinder 108, also remain longitudinally and rotationally fixed within assembled tool 100. Similarly, since cage cylinder 112 is longitudinally fixed, but is rotatable around the axis of the assembled tool 100, the inner pins 162, which are screwed into cage cylinder 112 also remain longitudinally fixed, but can revolve around the axis of the assembled tool 100.

Since the lower end 174 of cage cylinder 112 is always flush with the upper end 122 of lower sub 104, every downstroke of ratchet tube 110 induces unidirectional rotation on cage cylinder 112, and causes the exits of the first pair of flow channels 168 and the second pair of flow channels 180 to get alternately aligned and be flush against, respectively, the entrances of first pair of opposed fluid ejection paths 182 and the second pair of opposed fluid ejection paths 184.

In assembled tool 100, the central bore 103 of upper sub 102, the central bore 105 of the primary tube 130, the central bore 156 of ratchet tube 112, the central bore 160 of cage cylinder 112, along with the first pair flow channels 168, the second pair of flow channels 180, and with either of the first pair of fluid ejection paths 182 or the second pair of flow channels 184, provide a combined flow path for the fluid to flow through the tool 100.

Still further, in assembled tool 100, multiple sealing O-rings are installed at the interfaces between various components of tool 100 (see FIG. 1A) to prevent leakage. As illustrated, O-ring 111 is installed on upper sub 102 to lie between the inner surface of the covering barrel 106 and the outer surface of upper sub 102. O-ring 113 is installed on primary tube 130 to lie between the inner surface of upper sub 102 and the outer surface of primary tube 130. O-ring 115 is installed on cage cylinder 112 to lie between the inner surface of guiding cylinder 108 and the outer surface of cage cylinder 112. O-ring 117 is installed on lower sub 104 to lie between the inner surface of covering barrel 106 and the outer surface of lower sub 104.

When tool 100 is installed in a wellbore, an internally threaded upper end of bore 103 of upper sub 102 is fixed with the string or coiled tubing (or other equipment assembly in the well-bore) to receive fluid inflow. Fluid is pumped into tool 100 through the bore 103 of upper end 124 of upper sub 102. The high pressure fluid travels through tool 100, and gets ejected through either the first pair of opposed fluid ejection paths 182 or the second pair of opposed fluid ejection paths 184 of lower sub 104.

Pressurized fluid, if flowing through the second pair of opposed fluid ejection paths 184, gets delivered into bore 183 of lower sub 104, gets ejected from its lower end 126, and finally gets delivered into the Bottom Hole Assembly (BHA), or other equipment assembly, connected to the externally threaded region 128 of lower sub 104. At this stage the tool 100 is operating in "flow-through" mode. Similarly, pressurized fluid, if flowing through the first pair of fluid ejection paths 182, gets ejected from tool 100 through the sides of lower sub 104, hence operating in active "annular-flow" mode.

Operation of tool 100, when installed downhole in a wellbore will now be explained with the help of accompanying figures (see FIGS. 1A, 1B, 3A, 3B, 4A and 4B).

FIGS. 1A and 1B illustrate longitudinal cross-sectional views of the assembled tool 100, lying in a state of rest prior to fluid flow, taken along cutting planes which are transverse to each other. At this stage no fluid flows through the tool or through fluid ejection paths 182 or 184, because the entrances of fluid ejection paths 182 and 184 are not sealed by metallic sealing balls 172.

To set the tool in "flow-through" mode at a desired location downhole, tool 100 is affixed to coiled tubing and lowered into the wellbore until it reaches the target site. Thereafter, to operate tool 100, in the first step, high pressure flow of fluid is pumped into upper sub 102. High pressure fluid flows through central bore 103 of upper sub 102 and is delivered into the central bore 105 of primary tube 130. Since primary tube 130 is screwed together with upper sub 102 and it remains stationary within the tool 100, the outwardly tapered expanded region 121 on the upper portion of the central bore 105 narrows the stream of fluid flowing through it and enhances its flow pressure. After flowing through the primary tube 130, the stream of high pressure fluid gets delivered into the central bore 156 of ratchet tube 110. As the fluid enters the tapered flow section 157 of central bore 156, downward pressure is exerted on ratchet tube 110. If the downward pressure on ratchet tube 110 is sufficient to overcome the resistive compression force of spring 114, it causes a downward slide (or a downstroke) of ratchet tube 110. Though the outer pin heads 158, which are engaged with peak channels 146, permit longitudinal displacement (either downwards or upwards), they ensure that no non-linear deviation is induced ratchet tube 110.

However, since the inner pin heads 164 are engaged with ratchet path 140, the downward slide of ratchet tube 110 causes inner pin heads 164 to slide along the slant edges of the peaks 142, thereby inducing a rotational torque on cage cylinder 112 and causing its rotation by 45 degrees. Along with cage cylinder 112, inner pins 162 and their respective inner pin heads 164 also get revolved by 45 degrees. Note that engagement of stationary outer pin heads 158 with the peak channels 146 inhibits the rotation of ratchet tube 110. Hence, since ratchet tube 110 can't rotate, engagement of inner pin heads 164 with the slant edges of peaks 142 induces a rotational torque on cage cylinder 112.

As a result of the rotation of cage cylinder 112, the first pair of flow channels 168 gets aligned with the first pair of opposed fluid ejection paths 182, and the second pair of flow channels 180 gets aligned with the second pair of fluid ejection paths 184. During the execution of the downstroke of ratchet tube 110, initially, the downward flowing high pressure fluid gets delivered into flow channels 168 and 180. While flowing through the first pair of flow channels 168, the pressurized fluid pushes metallic sealing balls 172, included in the first pair of flow channels 168, against the entrances of first pair of opposed fluid ejection paths 182 and seals them (see FIG. 3A).

Figure 3A:
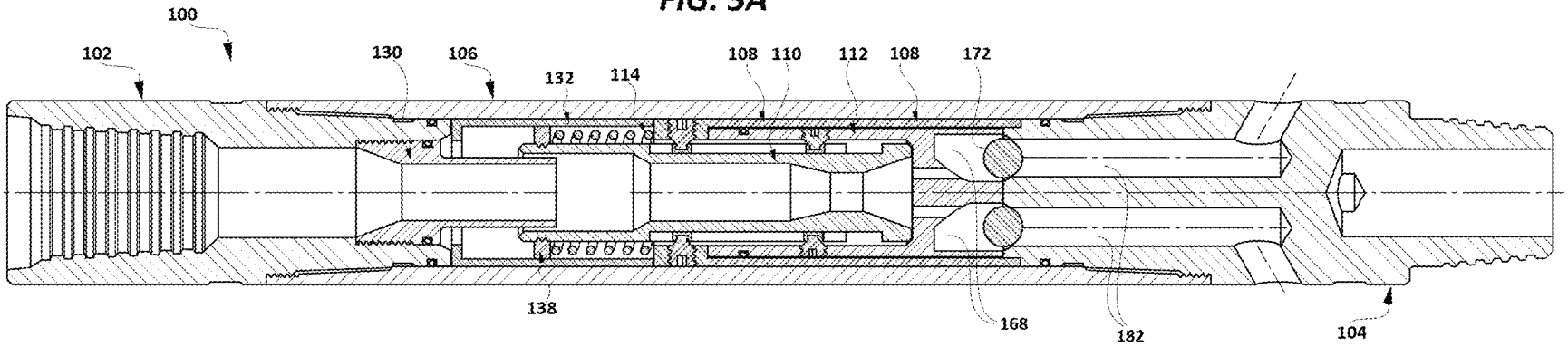
FIGS. 3A and 3B show longitudinal cross-sectional views of the tool during downstroke of the ratchet tube with pressurized fluid flowing through, while operating in "flow-through" mode.
Figure 3B:
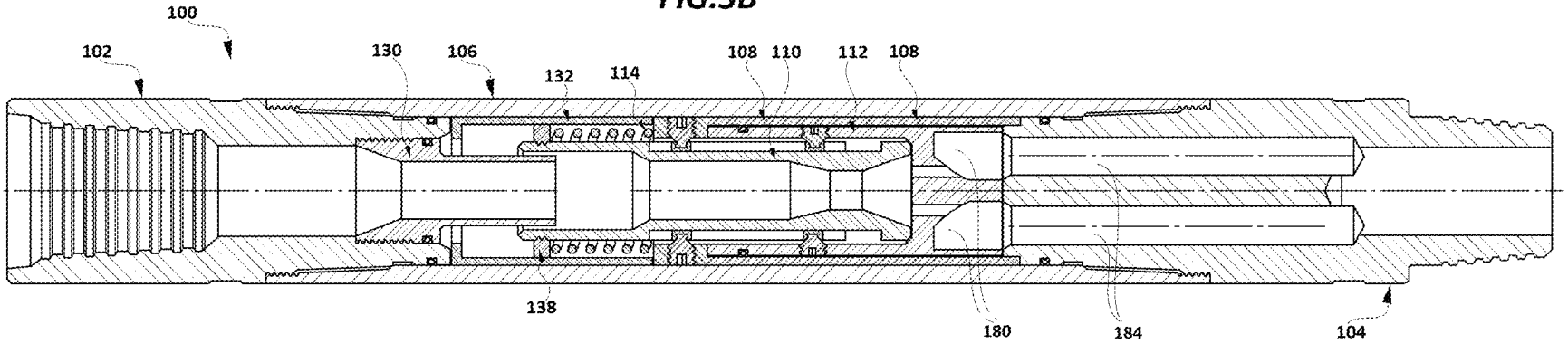

At this stage, while fluid flow through the first pair of opposed fluid ejection paths 182 is blocked by metallic sealing balls 172, pressurized fluid continues to flow only through the second pair of opposed fluid ejection paths 184, entrances of which are not blocked by metallic sealing balls 172 (see FIG. 3B). After flowing through the second pair of opposed fluid ejection paths 184, pressurized fluid gets delivered into bore 183 of lower sub 104, and finally gets ejected from its lower end 126. Thereafter, the ejected fluid gets delivered into the Bottom Hole Assembly (BHA), or other equipment assembly, connected to the externally threaded region 128 of lower sub 104. At this stage the tool 100 is operating in "flow-through" mode.

In order to switch the operating mode of the tool to "annular-flow" mode, and to switch fluid ejection path sealing from currently sealed first pair of opposed fluid ejection paths 182 to currently unsealed second pair of opposed fluid ejection paths 184, in the first step, flow of pressurized fluid through the tool 100 is interrupted (or its pressure is reduced). When the fluid pressure falls below a threshold, it results in an immediate reduction of the force on ratchet tube 110 and on the compressed spring 114. Spring 114 expands and generates an upward force on ratchet tube 110, and results in upward movement of ratchet tube 110. As explained above, since the inner pin heads 164 are engaged with ratchet path 140, the upward slide of ratchet tube 110 causes the inner pin heads 164 to slide along the slant edges of valley crests 144. The engagement of stationary outer pin heads 158 with the peak channels 14 inhibits the rotation of ratchet tube 110. Hence, since ratchet tube 110 can't rotate, engagement of inner pin heads 164 with slant edges of valley crests 144 induces a rotational torque on cage cylinder 112, through inner pin heads 164. Sliding of inner pin heads 164 on slant edges of valley crests 144 next induces rotational torque on cage cylinder 112 and results in it rotating a further 45 degrees in the same direction as during the downward sliding. Along with cage cylinder 112, inner pins 162 and their respective inner pin heads 164 also get rotated by 45 degrees. During rotation of cage cylinder 112, the first pair of opposed flow channels 168, which include metallic sealing balls 172, also rotate and sweep away metallic sealing balls 172 from the entrances of the first pair of opposed fluid ejection paths 182 and unseal them.

At this stage, since all flow channels (i.e., both flow channels 168 and both flow channels 180) have rotated only by 45 degrees, flow channels 168 and flow channels 180 are not aligned with entrances of fluid ejection paths 182 or fluid ejection paths 184. A rotation of 90 degrees of cage cylinder 112 is needed for making a complete alternating alignment of flow channels with fluid ejection paths. Due to current non-alignment, at this stage, fluid ejection paths 182 and fluid ejection paths 184 are not sealed by metallic sealing balls 172, though some inconsequential amount of fluid may nevertheless flow through the tool 100.

In the next step, flow of pressurized fluid through tool 100 is reinstated to initiate another downward slide (or downstroke) of ratchet tube 110. As explained above, downward slide of ratchet tube 110 results in further 45 degree rotation of cage cylinder 112, inner pins 162 and their respective inner pin heads 164, in the same direction. The result is alignment of first pair of flow channels 168 and second pair flow channels 180 with corresponding alternate pair of fluid ejection paths (i.e., the first pair of flow channels 168 gets aligned with the second pair of fluid ejection paths 184, and the second pair of flow channels 180 gets aligned with first pair of opposed fluid ejection paths 182). As the pressurized fluid flows through the first pair of flow channels 168, it pushes metallic sealing balls 172, situated in the first pair of flow channels 168, against the entrances of second pair of opposed fluid ejection paths 184 and seals them (see FIG. 4A).

Figure 4A:
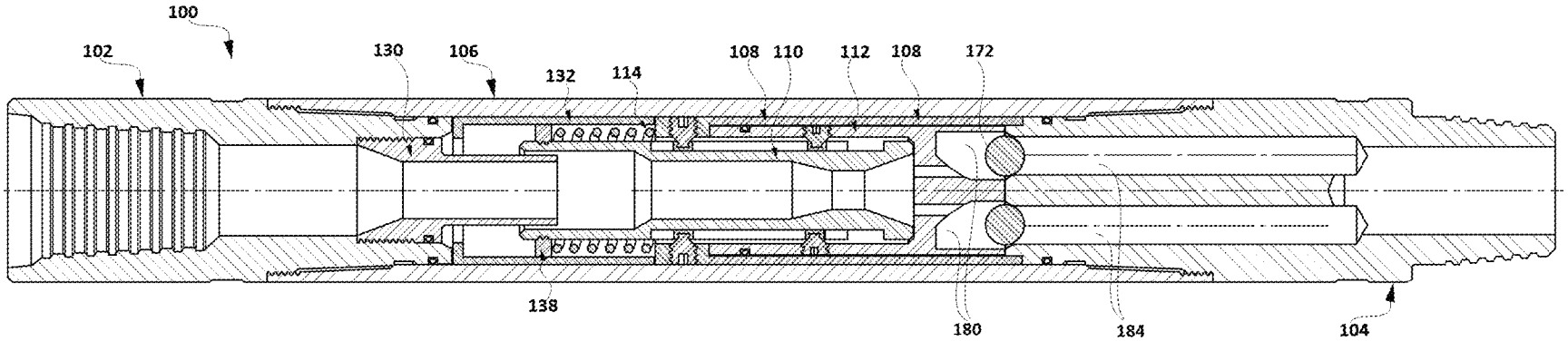
FIGS. 4A and 4B show longitudinal cross-sectional views of tool during downstroke of the ratchet tube with pressurized fluid flowing through, while operating in "annular-flow" mode.
Figure 4B:
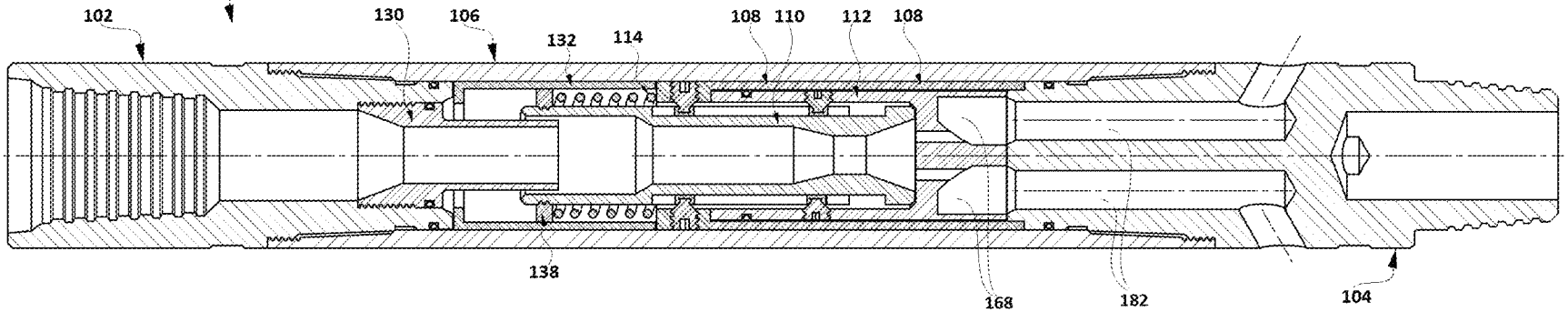

At this stage, while fluid flow through the second pair fluid ejection paths 184 is blocked by metallic sealing balls 172, pressurized fluid flows only through the first pair fluid ejection paths 182, and gets ejected from their corresponding exits at the sides of lower sub 104 (see FIG. 4B). Flow of pressurized fluid from the first pair of fluid ejection paths 182 results in setting the tool 100 in the "annular-flow" mode.

In an operating tool, the downstrokes of ratchet tube 110 can be generated as and when required by interrupting (or reducing) and then reinstating flow of pressurized fluid through the tool 100. Hence, based on the requirements, fluid ejection from either first pair of opposed fluid ejection paths 182 or the second pair of opposed fluid ejection paths 184 be blocked (by sealing their entrances with metallic sealing balls 172) while being allowed from the other pair. Cycling the tool's operation between flow-through and annular-flow modes is thus achieved by cyclically interrupting (or reducing) and then reinstating of flow of pressurized fluid.

All components of the fluid-driven dual-mode circulation tool 100 described above, including metallic sealing balls 172, are made of metal or metal alloy.

The metallic sealing balls 172 are sized to prevent them from getting flushed, during the tool's operation, into fluid ejection paths 182 or 184, or from there into the central bore 183 of lower sub 104. Further, the inner diameter of each of the four connecting channels 170 (see FIG. 1A) is smaller than the outer diameters of metallic sealing balls 172 to prevent them from rolling back into the central bore of cage cylinder 112. Hence, in an assembled tool 100, metallic sealing balls 172 are confined to move only within their respective flow channel among the first pair of flow channels 168.

It is to be noted that the specifications of spring 114 in terms of the fluid pressure required to cause its compression and expansion during operation of the tool 100 are known. So, the amount of fluid pressure which would overcome the force of spring 114 and push ratchet tube 110 down, and the amount of fluid pressure which would not withstand the expansive force of compressed spring 114 are known to the operator of the tool.

The structure and dimensions of ratchet path 140, peaks 142, valley crests 144 and the peak channels 146 are selected to be in proportion with those of other components of tool 100 such that a unidirectional rotation of 45 degrees is induced on cage cylinder 112 on every downward or upward displacement of ratchet tube 110. In other embodiments of the invention, on every downstroke and upstroke of the cage cylinder 112, rotation of cage cylinder 112 by prefixed angles other than 45 degrees may very well be achieved by altering the structure, contour and dimensions of ratchet path 140, peaks 142, valley crests 144 and the peak channels 146 in proportion with other components.

In other possible embodiments of the present invention, instead of two pairs of fluid ejection paths (as described above), lower sub may include additional fluid ejection paths. Similarly, in other possible embodiments of the present invention, instead of two pairs of flow channels (as described above), cage cylinder may include additional pair of fluid ejection paths. In such embodiments alterations in the structure and dimensions of ratchet path allows alternating alignment between flow channels and fluid ejection paths during operation of the tool.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A fluid-driven dual-mode circulation tool, wherein interrupting and then reinstating the inflow of pressurized fluid through the tool allows switching between a flow-through mode and an annular-flow mode, comprising:

a first set of fluid ejection paths which can be blocked or selectively connected with a central bore in the tool, said first set of fluid ejection paths exiting on the sides of the tool;

a second set of fluid ejection paths which can be blocked or selectively connected with the central bore, said second set of fluid ejection paths exiting at the lower end of the tool;

a ratchet tube having a zig-zagging ratchet path including alternating peaks and valleys around its outer surface and one or more longitudinal peak channels connecting with the ratchet path and extending longitudinally, said peak channels adapted to engage with one or more outer pins fixed on an inner wall of the tool, and wherein said inner wall surrounds at least a portion of a length of the ratchet tube;

said ratchet path is adapted to engage with one or more inner pins fixed on an inner surface of a cage cylinder, wherein said cage cylinder surrounds at least a portion of the length of the ratchet tube, and said cage cylinder includes two pairs of opposed flow channels, each of said flow channels being connected from a central bore of the cage cylinder and extending to its lower end, and each of said pairs of flow channels adapted to accommodate a sealing ball, wherein said sealing balls move within a corresponding flow channel;

said ratchet tube is rotationally fixed with respect to the inner wall but is slidable in a confined range, and said cage cylinder is rotatable on its axis but longitudinally fixed within the tool, and said cage cylinder and said ratchet tube are axially aligned;

a spring which is compressed to apply a force to move the ratchet tube upwards in the tool such that both the first and the second set of fluid ejection paths access the central bore of the tool, thereby permitting flow through both the first and the second set of fluid ejection paths, wherein each downstroke of the ratchet tube, caused by flow of pressurized fluid through the tool, causes the cage cylinder to rotate and to alternately align exits of each pair of flow channels with the entrance of the first set and the second set of fluid ejection paths, thus causing the sealing balls to alternately seal the entrances of the first set and the second set of fluid ejection paths, ejection of pressurized fluid from the first set of fluid ejection paths sets the tool in the annular-flow mode, and ejection of pressurized fluid from the second set of fluid ejection paths sets the tool in the flow-through mode.

2. The tool of claim 1, wherein said inner wall is an inner surface of a guiding cylinder that surrounds at least a portion of the ratchet tube.

3. The tool of claim 1, wherein said sealing balls are made of a metal or a metal alloy.

4. The tool of claim 3, wherein said metal alloy is steel.

5. The tool of claim 1, wherein each of said outer pins further includes an outer pin head wherein said outer pin head can engage with a corresponding peak channel.

6. The tool of claim 1, wherein each of said inner pins further includes an inner pin head wherein said inner pin head can engage with the ratchet path.

7. A method to switch the operating fluid discharge mode of the tool, wherein interrupting and then reinstating the inflow of pressurized fluid through the tool allows switching between a flow-through mode and an annular-flow mode, the method comprising:

initiating flow of pressurized fluid through the tool, the tool comprising, a first set of fluid ejection paths which can be blocked or selectively connected with a central bore in the tool, first set of fluid ejection paths exiting on the sides of the tool;

a second set of fluid ejection paths which can be blocked or selectively connected with the central bore and exiting at a lower end of the tool;

a ratchet tube having a zig-zagging ratchet path including alternating peaks and valleys around its outer surface and one or more longitudinal peak channels connecting with the ratchet path and extending longitudinally, said peak channels adapted to engage with one or more outer pins fixed on an inner wall of the tool, and wherein said inner wall surrounds at least a portion of a length of the ratchet tube, and is rotationally and longitudinally fixed within the tool, said ratchet path is adapted to engage with one or more inner pins fixed on an inner surface of a cage cylinder, wherein said cage cylinder surrounds at least a portion of the length of the ratchet tube, and said cage cylinder includes two pairs of opposed flow channels, each of said flow channels being connected from a central bore of the cage cylinder and extending to its lower end, and each of said pairs of flow channels adapted to accommodate a sealing ball, wherein said balls are confined to move within a corresponding flow channel, said ratchet tube is rotationally fixed with respect to the inner wall but is slidable in a confined range, and said cage cylinder is rotatable on its axis but longitudinally fixed within the tool, and said cage cylinder and said ratchet tube are axially aligned;

a spring, which is compressed, to apply a force to move the ratchet tube upwards in the tool such that both the first and the second set of fluid ejection paths are accessing the central bore of the tool, thereby permitting flow through both the first and the second set of fluid ejection paths; and wherein each downstroke of the ratchet tube, caused by flow of pressurized fluid through the tool, causes the cage cylinder to rotate and to alternately align exits of each pair of flow channels with the entrances of the first set and the second set of fluid ejection paths, thus causing the sealing balls to alternately seal the entrances of the first set and the second set of fluid ejection paths;

interrupting and then reinstating the flow of pressurized fluid through the tool to alternately allow ejection of pressurized fluid from the first set of fluid ejection paths and from the second set of fluid ejection paths, wherein ejection of pressurized fluid from the first set of fluid ejection paths sets the tool in the annular-flow mode, and ejection of pressurized fluid from the second set of fluid ejection paths sets the tool in the flow-through mode.

8. The method of claim 7, wherein said inner wall is an inner surface of a guiding cylinder that surrounds at least a portion of the ratchet tube.

9. The method of claim 7, wherein said sealing balls are made of a metal or a metal alloy.

10. The method of claim 9, wherein said metal alloy is steel.

11. The method of claim 7, wherein each of said outer pins further includes an outer pin head wherein, said outer pin head can engage with the peak channels.

12. The method of claim 7, wherein each of said inner pins further includes an inner pin head wherein, said inner pin head can engage with the ratchet path.

13. The method of claim 7, wherein said sealing of the entrances of the first set of fluid ejection paths causes the tool to rest in flow-through mode.

14. The method of claim 7, wherein said sealing of the entrances of the second set of fluid ejection paths causes the tool to operate in annular-flow mode.

* * * * *